US009700761B2

(12) United States Patent
Beaver et al.

(10) Patent No.: US 9,700,761 B2
(45) **Date of Patent: *Jul. 11, 2017**

(54) FUNCTIONAL TRAINING RIG KIT

(71) Applicant: Beaverfit Limited, Church Stretton Shropshire (GB)

(72) Inventors: Tom Beaver, Church Stretton Shropshire (GB); Jim Beaver, Church Stretton Shropshire (GB)

(73) Assignee: Beaverfit Limited, Church Stretton Shropshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,297

(22) Filed: Mar. 1, 2016

(65) Prior Publication Data

US 2016/0175653 A1 Jun. 23, 2016

Related U.S. Application Data

(63) Continuation of application No. 14/388,554, filed as application No. PCT/EP2013/067139 on Aug. 16, 2013, now Pat. No. 9,308,410.

(30) Foreign Application Priority Data

Aug. 16, 2012 (GB) ..... 1214599.1

(51) Int. Cl.
*A63B 26/00* (2006.01)
*A63B 17/00* (2006.01)
(Continued)

(52) U.S. Cl.
CPC ..... *A63B 26/00* (2013.01); *A63B 17/00* (2013.01); *A63B 17/04* (2013.01); *A63B 21/04* (2013.01);
(Continued)

(58) Field of Classification Search
CPC ..... A63B 5/16; A63B 17/00; A63B 17/04; A63B 21/04; A63B 21/0724; A63B 21/16;
(Continued)

(56) References Cited

U.S. PATENT DOCUMENTS 2,219,219 A 10/1940 Boger
2,632,645 A 3/1953 Barkschat
(Continued)

FOREIGN PATENT DOCUMENTS

DE 20110717 U1 9/2001
EP 0384702 A1 8/1990
(Continued)

OTHER PUBLICATIONS

The Tactical Gym Box by TACWRK Blog dated Apr. 10, 2014, Found online [Feb. 5, 2016], http://www.tacwrk.com/blog/5-11-recon-serie/2014/04, 6 pages.
(Continued)

*Primary Examiner* — James Ference
(74) *Attorney, Agent, or Firm* — Fay Sharpe LLP

(57) ABSTRACT

A functional training rig kit includes a box and a plurality of components adapted to fit within the box. At least some of the components and the box include elements by which the components are adapted to be attached to the outside of the box to provide at least one functional training rig attached to the outside of the box.

19 Claims, 23 Drawing Sheets

(51) Int. Cl.

| | |
|---|---|
| ***A63B 21/04*** | (2006.01) |
| ***A63B 21/16*** | (2006.01) |
| ***A63B 23/04*** | (2006.01) |
| ***A63B 71/00*** | (2006.01) |
| ***E04H 3/10*** | (2006.01) |
| ***A63B 17/04*** | (2006.01) |
| ***B65D 81/00*** | (2006.01) |
| ***B65D 25/02*** | (2006.01) |
| ***B65D 25/20*** | (2006.01) |
| ***B65D 88/02*** | (2006.01) |
| *A63B 71/02* | (2006.01) |
| *A63B 5/16* | (2006.01) |
| *A63B 21/072* | (2006.01) |

(52) U.S. Cl.

CPC ..... *A63B 21/16* (2013.01); *A63B 23/0458* (2013.01); *A63B 71/0036* (2013.01); *A63B 71/02* (2013.01); *B65D 25/02* (2013.01); *B65D 25/20* (2013.01); *B65D 81/00* (2013.01); *B65D 88/02* (2013.01); *E04H 3/10* (2013.01); *A63B 5/16* (2013.01); *A63B 21/0724* (2013.01); *A63B 2071/025* (2013.01); *A63B 2210/00* (2013.01); *A63B 2210/50* (2013.01); *A63B 2225/10* (2013.01)

(58) Field of Classification Search

CPC . A63B 23/0458; A63B 26/00; A63B 71/0036; A63B 71/02; A63B 2071/025; A63B 2210/00; A63B 2210/50; A63B 2225/10; B65D 25/02; B65D 25/20; B65D 81/00; B65D 88/02; E04H 3/10

See application file for complete search history.

(56) References Cited

U.S. PATENT DOCUMENTS 2,682,402 A 6/1954 McCarthy
2,855,200 A 10/1958 Blickman
3,275,369 A 9/1966 Ecke
3,295,847 A 1/1967 Matt, Sr.
3,664,666 A 5/1972 Lloyd
3,874,657 A 4/1975 Niebojewski
4,300,761 A 11/1981 Howard
4,431,181 A 2/1984 Baswell
4,637,608 A 1/1987 Owens et al.
D289,782 S 5/1987 Szymski et al.
D290,033 S 5/1987 Policastro
4,759,539 A 7/1988 Nieppola
4,815,746 A 3/1989 Ward, Jr.
4,828,255 A 5/1989 Lahman
4,907,798 A 3/1990 Burchatz
4,921,245 A 5/1990 Roberts
4,927,135 A 5/1990 Nieppola
4,958,874 A * 9/1990 Hegedus ..... B60P 3/0252 296/175
4,976,428 A 12/1990 Ghazi
4,976,623 A 12/1990 Owsley
5,013,035 A 5/1991 Nathaniel
5,046,722 A 9/1991 Antoon
D321,735 S 11/1991 Blubaugh
5,242,345 A 9/1993 Mitchell
D356,351 S 3/1995 Watts
5,405,306 A 4/1995 Goldsmith et al.
5,449,336 A 9/1995 Sabel
5,466,204 A 11/1995 Nearing
D368,288 S 3/1996 Kasbohm
5,542,897 A 8/1996 Hall
5,573,238 A 11/1996 Aaron et al.
5,575,742 A 11/1996 Wu
D381,715 S 7/1997 Reeder
5,667,267 A * 9/1997 Talucci ..... B60P 3/34 296/26.15
5,667,461 A 9/1997 Hall
5,816,646 A 10/1998 Combest
D401,985 S 12/1998 Wheeler
D408,480 S 4/1999 Haugo
5,966,956 A 10/1999 Morris et al.
5,971,898 A 10/1999 Schoolfield
6,027,429 A 2/2000 Daniels
D425,152 S 5/2000 Ceppo
6,090,021 A 7/2000 Flowers et al.
D439,641 S 3/2001 Dumas
D441,813 S 5/2001 Ceppo
6,245,001 B1 6/2001 Siaperas
6,264,586 B1 * 7/2001 Webber ..... A63B 21/078 482/104
6,273,846 B1 8/2001 Savage et al.
6,280,361 B1 8/2001 Harvey et al.
6,350,221 B1 2/2002 Krull
6,422,981 B1 7/2002 Riser
6,454,683 B1 9/2002 Kaye
6,520,890 B2 2/2003 Hsu
6,554,747 B1 4/2003 Rempe
6,558,301 B1 5/2003 Jackson
6,612,845 B1 9/2003 Macri et al.
6,634,998 B2 10/2003 Siaperas
D495,380 S 8/2004 Ceppo
D495,381 S 8/2004 Ceppo
D495,383 S 8/2004 Ceppo
6,881,178 B1 4/2005 Goldberg
7,070,547 B1 7/2006 Pater
7,311,642 B2 12/2007 Li et al.
D565,132 S 3/2008 Lien et al.
7,488,277 B1 2/2009 Knapp
7,520,840 B2 4/2009 Shifferaw
D597,614 S 8/2009 Goddard
7,575,538 B1 8/2009 Clark
7,614,988 B1 11/2009 Kiser
7,930,857 B2 * 4/2011 Pope ..... E04B 1/3431 52/64
D666,259 S 8/2012 Garcia
D671,997 S 12/2012 Lien
D678,963 S 3/2013 James
8,485,951 B1 7/2013 Adams
8,942,321 B2 * 1/2015 Shental ..... H04L 25/0248 375/316
D727,444 S 4/2015 Dixon
D731,601 S 6/2015 Bradley et al.
2002/0078861 A1 6/2002 David
2003/0119611 A1 * 6/2003 Lytle ..... A63B 63/004 473/434
2003/0146212 A1 8/2003 Mai et al.
2003/0213188 A1 11/2003 Bigelow
2004/0237870 A1 12/2004 Clarke et al.
2005/0032612 A1 2/2005 Keiser
2005/0032613 A1 2/2005 Wehrell
2006/0052220 A1 3/2006 Jackson et al.
2006/0145514 A1 7/2006 Cardwell et al.
2006/0186638 A1 8/2006 Varner
2006/0199706 A1 9/2006 Wehrell
2006/0293156 A1 12/2006 Trees
2007/0032357 A1 2/2007 Piane, Jr.
2007/0113487 A1 5/2007 Warminsky
2007/0117503 A1 5/2007 Warminsky
2007/0161468 A1 7/2007 Yanagisawa et al.
2007/0232461 A1 10/2007 Jenkins et al.
2008/0128463 A1 6/2008 Bryan
2009/0017997 A1 1/2009 Piggins
2009/0023566 A1 1/2009 Florczak
2009/0069125 A1 * 3/2009 Porter ..... A63B 69/0097 473/435
2009/0072111 A1 3/2009 Piane, Jr.
2009/0098987 A1 4/2009 McBride et al.
2009/0124464 A1 5/2009 Kastelic
2009/0143160 A1 6/2009 Hoganson
2009/0176588 A1 7/2009 Lochtefeld
2009/0215594 A1 8/2009 Panaiotov
2009/0282749 A1 11/2009 Warminsky
2010/0048368 A1 2/2010 Donofrio
2010/0124996 A1 5/2010 Lindsay

(56) References Cited

U.S. PATENT DOCUMENTS

| | | | | |
|---|---|---|---|---|
| 2010/0251584 | A1* | 10/2010 | Bey | G09F 15/00 40/606.03 |
| 2010/0300906 | A1 | 12/2010 | Moore | |
| 2011/0023925 | A1* | 2/2011 | Johnson | B60P 3/341 135/139 |
| 2011/0152046 | A1 | 6/2011 | Rochford | |
| 2011/0195822 | A1 | 8/2011 | Donofrio | |
| 2011/0319230 | A1 | 12/2011 | Brendle | |
| 2012/0077429 | A1 | 3/2012 | Wernimont et al. | |
| 2012/0142506 | A1 | 6/2012 | Hetrick et al. | |
| 2012/0144762 | A1 | 6/2012 | Eatock et al. | |
| 2012/0214651 | A1 | 8/2012 | Ross | |
| 2013/0053220 | A1 | 2/2013 | Monaco | |
| 2015/0014212 | A1* | 1/2015 | Beaver | A63B 23/0458 206/579 |
| 2015/0059257 | A1* | 3/2015 | Beaver | A63B 17/00 52/27 |
| 2015/0290488 | A1 | 10/2015 | Hopperstad et al. | |

FOREIGN PATENT DOCUMENTS

| | | | |
|---|---|---|---|
| FR | 2 959 670 | A1 | 11/2011 |
| GB | 648641 | A | 1/1951 |
| GB | 2 463 092 | A | 3/2010 |
| GB | 2 503 733 | A | 1/2014 |
| WO | WO 2014/046904 | A1 | 3/2014 |
| WO | WO 2014/169042 | A1 | 10/2014 |

OTHER PUBLICATIONS https://www.youtube.com/watch?v=YH_h5CXoVkg, "BeaverFit Wall Mounted Power Rig at CrossFit Bath", Uploaded Aug. 27, 2010.

https://www.youtube.com/watch?v=MsDAULtypz4, Jul. 2, 2012 [Accessed Dec. 3, 2014] 1 page.

https://crossfitpenrith.blogspot.co.uk/2009/08/rest-day.html#comment-form, Aug. 2, 2009 [Accessed Dec. 3, 2014] 1 page.

International Search Report of International Application No. PCT/EP2013/067139 dated Jan. 27, 2014, 5 pages.

* cited by examiner

FUNCTIONAL TRAINING RIG KIT

This application is a continuation of U.S. patent application Ser. No. 14/388,554 which was filed on Sep. 26, 2014 and is still pending. That application is an entry into the U.S. national phase of International Application Serial No. PCT/EP2013/067139 which was filed on Aug. 16, 2013. The disclosures of both of these applications are incorporated hereinto by reference in their entirety.

This invention relates to a kit for a functional training rig.

BACKGROUND

Functional training rigs are frameworks that allow one or more users to perform a range of functional training exercises, developing body strength using traditional body-weight exercises, as well as providing a structure to support accessories such as jumping platforms, grapplers, bungee hooks, dip bars and J-pegs which facilitate integration with other gym equipment to enhance the functionality of the rig by allowing additional exercises to be performed. To this end a functional training rig generally comprises a plurality of upright components, each supporting a cantilever, with horizontal bars interconnecting the cantilevers. A problem with such functional training rigs is that, once assembled, they are permanent structures which occupy a significant space. There are many situations where an individual or group wishes to undertake exercise in an area which is not permanently dedicated to fitness training alone, or an area which temporarily has no gymnasium, or a permanent fitness training area which has no storage for functional training rigs or other gym equipment. It would be desirable to be able to provide a functional training rig which can readily be assembled, dismantled and conveniently stored for transportation.

It is therefore an object of the present invention to provide a functional training rig which overcomes, or at least ameliorates, the above-mentioned problem.

BRIEF SUMMARY

According to the present invention there is provided a functional training rig kit comprising a box and a plurality of components adapted to fit within the box, at least some of the components and the box including means by which the components are adapted to be attached to the outside of the box to provide at least one functional training rig attached to the outside of the box.

The functional training rig may be attached to an external side wall of the box by means of a bracket which is substantially U-shaped in cross-section, with free ends of the legs of the U adjacent to the side wall and with securing means for the functional training rig provided in the base of the U. The securing means for the functional training rig may comprise an aperture provided through the base of the U and a captive nut secured inside the base of the U. Securing means may be provided in end regions of the bracket. The free end of the legs of the U adjacent to the side wall of the box may be interconnected by transverse ties. The transverse ties may be provided in end regions of the bracket. The transverse ties may be threaded and the bracket may be secured to the wall of the box by means of an attaching bracket provided internally of the box and provided with apertures such that threaded fasteners pass through the attaching bracket and the wall of the box and are received in threaded apertures in the transverse ties. The wall of the box may be corrugated and the bracket may be provided in a recesses wall portion of the corrugated wall.

Alternatively, components of the or each functional training rig may be assembled onto prepositioned plates provided on the outside of the box. The or each functional training rig may be attached to the outside of the box in such a way that vertical and/or horizontal movement between the functional training rig and the box is permitted. The or each functional training rig may be secured to the box by way of threaded or other suitable fasteners. The fasteners may pass through slots formed in at least one of the functional training rig and the pre-positioned plates to allow vertical and horizontal adjustment of the or each functional training rig relative to the box.

The box may be provided with hinged upright doors and or with side walls which open or fold away. A ramp may be provided in the region of the doors. The ramp may be removable or may be hinged so as to hinge back into the box when not in use.

The box may comprise an ISO shipping container, such as a 3 m, 6.1 m or 12.2 m ISO shipping container.

The box may be provided with internal lighting and/or ventilation and/or air-conditioning.

The roof of the box may be provided with a canopy. The canopy may be fastened over one or more of the top, front, rear and sides of the box, for example to provide protection from the weather.

Components of the or each functional training rig may be stored on storage racks within the box for transportation. A positive restraining device may be provided to secure components to the storage racks during transportation of the box. The racks may extend from the floor of the box to the roof thereof.

Accessories and attachments for the or each functional training rig may be stored within the box. The accessories and attachments may be stored on storage racks and/or in containers and/or in additional boxes. Such containers and/or additional boxes may be adapted to be secured to the floor of the box by threaded fasteners and/or brackets for transportation, but may be removed from the box and, once the accessories and attachments have been deployed, may be used, for example, for plyometric exercises. The additional boxes may be provided with wheels.

In use, the or each functional training rig may be supported on one or more ground-engaging plates.

The box may be provided with unique identification, such as a serial number applied to an identification plate.

A plurality of boxes may be arranged adjacent to each other. Respective adjoining sides and/or ends of the boxes may be arranged to fold away to create a larger single internal area.

Thus, the present invention provides a fully transportable functional training gym.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION

Figure 1:
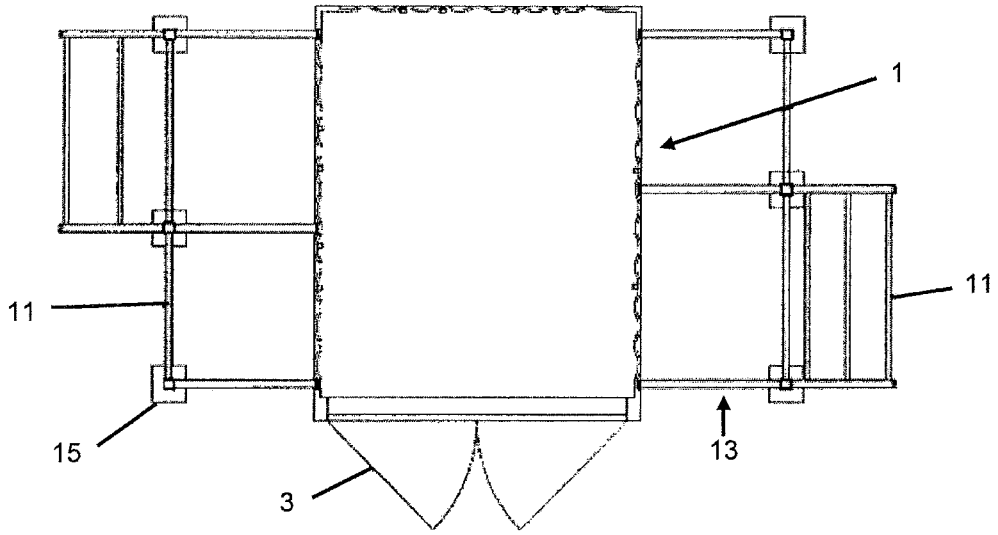
FIG. 1 is a plan view of one embodiment of a functional training rig assembled from a functional training rig kit according to the present invention.
Figure 2:
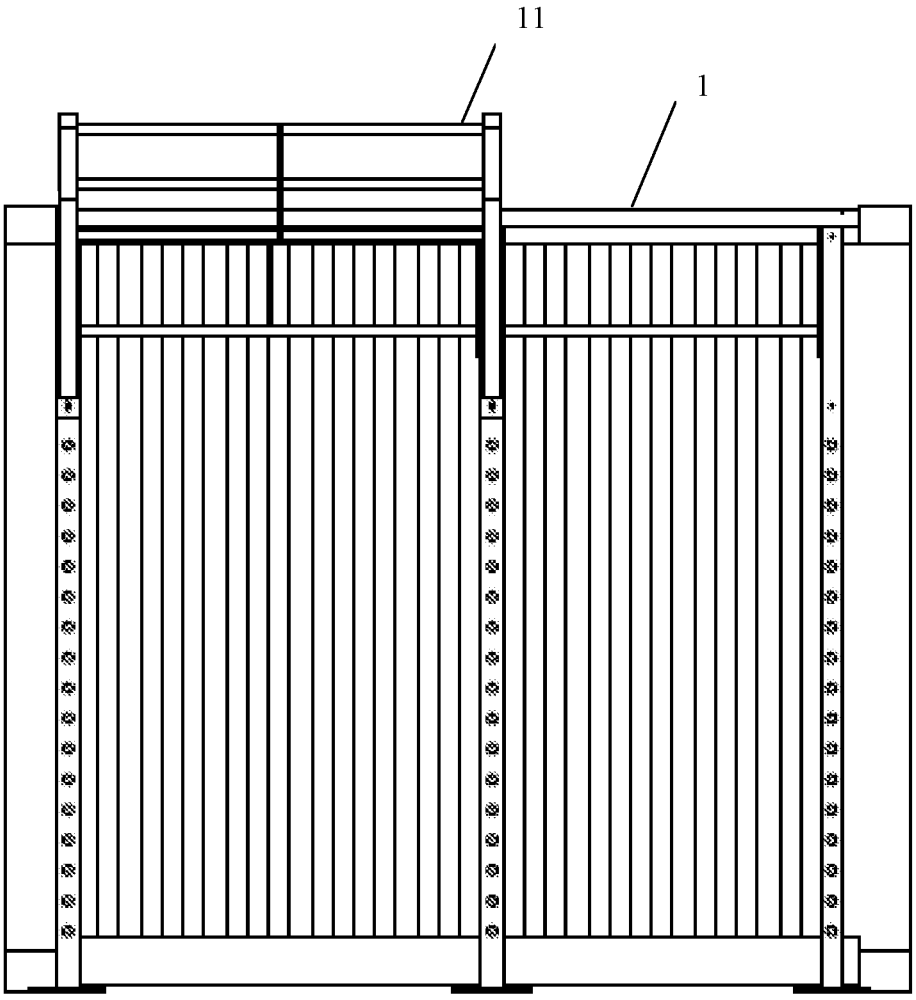
FIG. 2 is a front elevational view of the functional training rig shown in FIG. 1.
Figure 3:
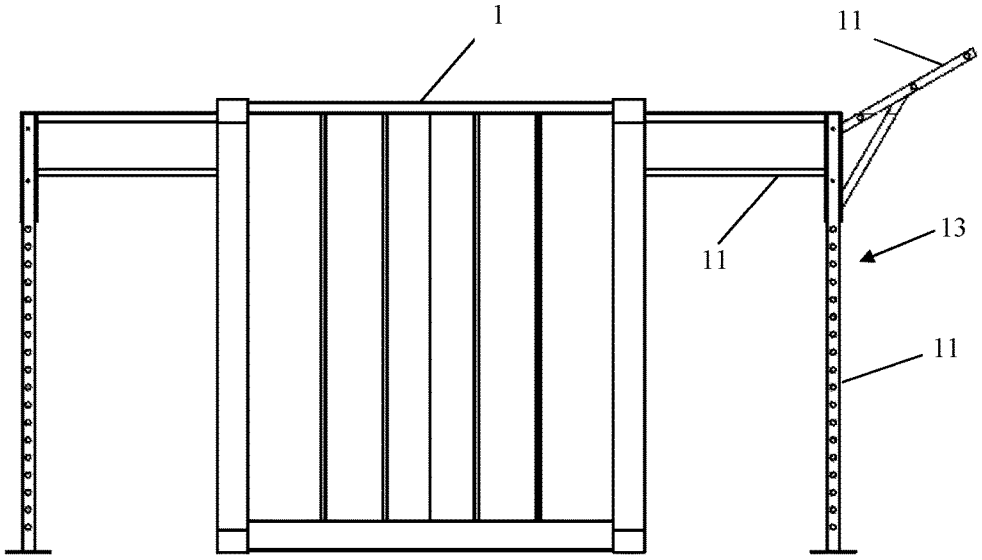
FIG. 3 is a rear elevational view of the functional training rig shown in FIG. 1.
Figure 4:
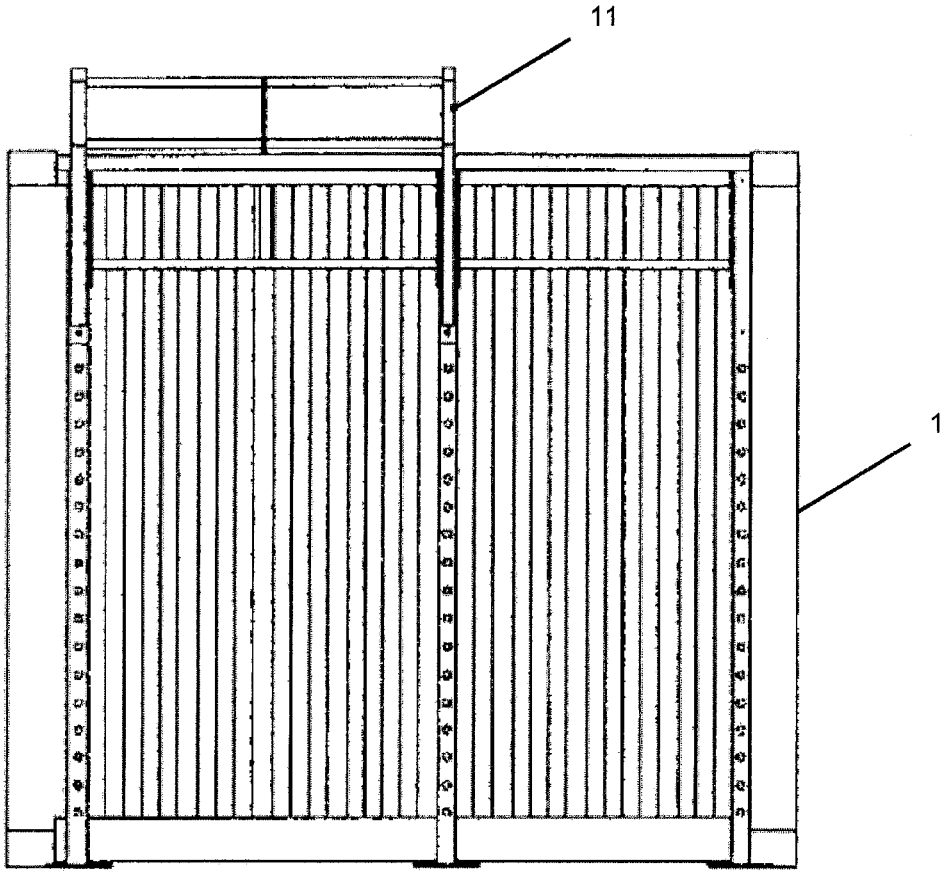
FIG. 4 is a side elevational view of the functional training rig shown in FIG. 1.
Figure 5:
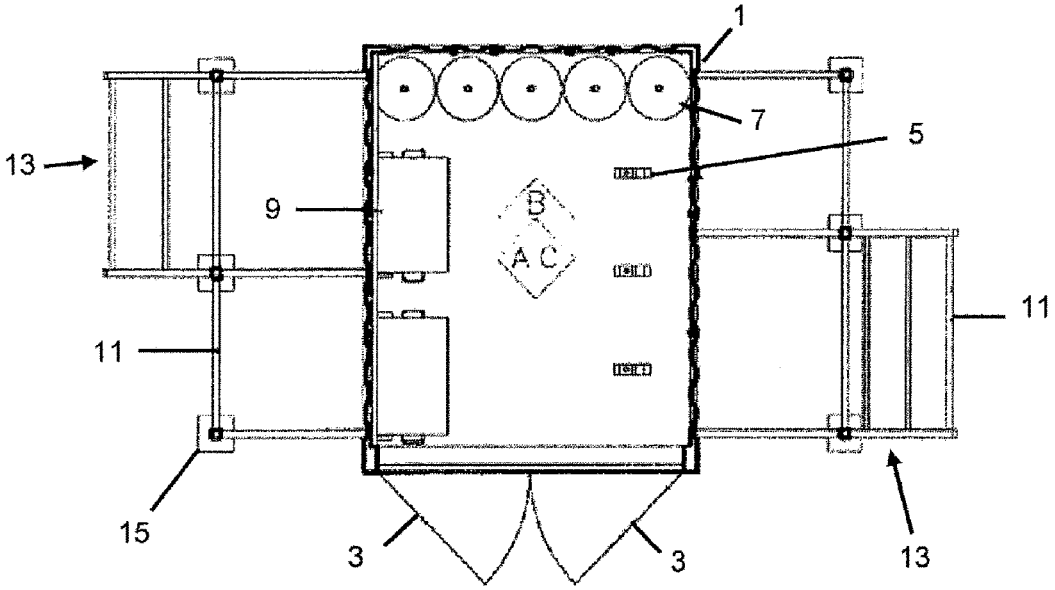
FIG. 5 is a plan view of the functional training rig shown in FIG. 1 with the top removed.
Figure 6:
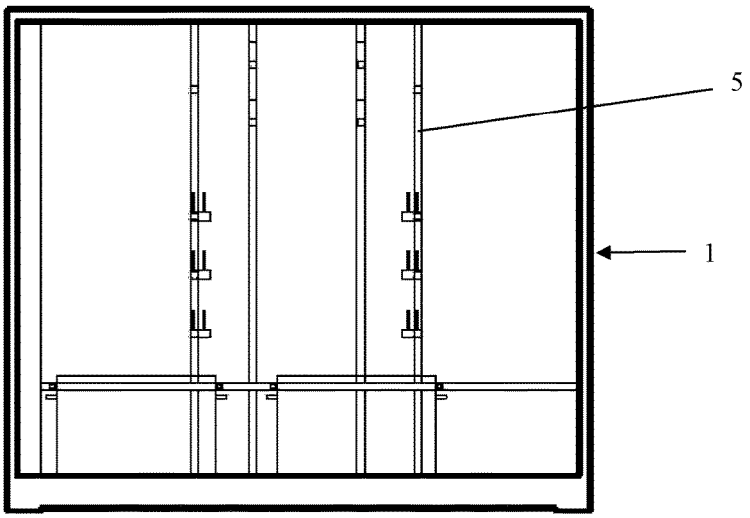
FIG. 6 is a cross-sectional view of the interior of the functional training rig shown in FIG. 1 in the direction A as shown in FIG. 5.
Figure 7:
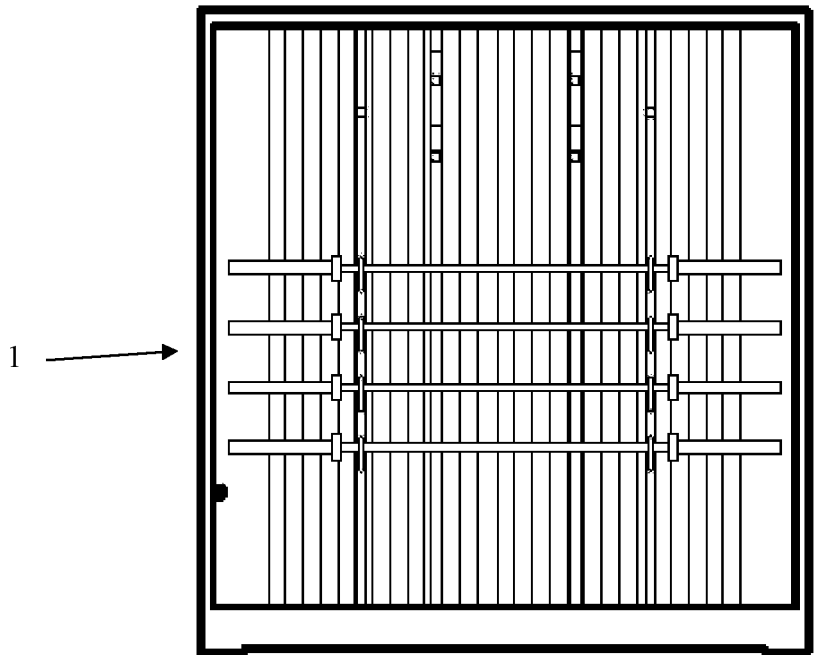
FIG. 7 is a cross-sectional view of the interior of the functional training rig shown in FIG. 1 in the direction B as shown in FIG. 5.
Figure 8:
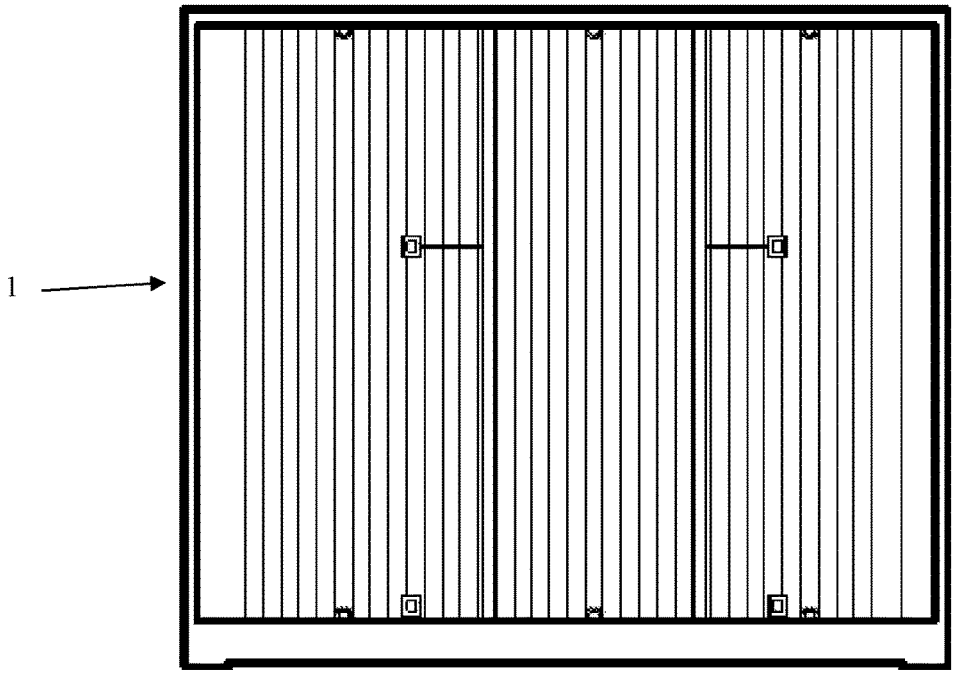
FIG. 8 is a cross-sectional view of the interior of the functional training rig shown in FIG. 1 in the direction C as shown in FIG. 5.

The functional training rig and functional training rig kit shown in FIGS. 1 to 8 comprises a box 1, for example in the form of an ISO shipping container, provided with upright hinged doors 3 at one end thereof. The box 1 is made of a suitable material, such as steel or aluminium and is readily transportable on a suitable transporter, such transporters being well-known for ISO shipping containers. The box 1 illustrated in FIGS. 1 to 8 is based around a 3 m ISO shipping container (having substantially a length of 3 m, a height of 2.4 m and a width of 2.4 m), although as will be explained hereinafter the box 1 can be based around alternative ISO shipping containers, such as 6.1 m and 12.2 m containers, or can alternatively be based around an alternative form of container. The doors 3 may be lockable if desired. As an alternative to the illustrated doors, access to the interior of the box may be by way of upright doors or side walls which open or fold away.

As will be explained in more detail hereinafter, components for a plurality of functional training rigs are stored within the box 1 for transportation, for example on suitable storage racks 5, which may be of the same material as the box, for example steel, and may be secured to the box by any suitable means, such as welding. The storage racks 5 extend from the floor of the box 1 to the roof thereof. The storage racks 5 allow the box 1 and its contents to be transported safely and without the risk of damage to the components. Accessories and attachments for the functional training rigs are also stored within the box 1. Accessories and attachments include bumper plates 7 and boxes 9 which may be secured to the floor of the box by threaded fasteners or brackets for transportation, but which may be removed from the box and, once the accessories and attachments have been deployed, may be used for plyometric exercises. If desired, the box 1 may be provided with internal lighting to facilitate moving items into and out of the box. Additionally or alternatively, the box may be provided with ventilation and/or air conditioning. Moreover, if desired, in order to provide more internal space after the box 1 has been delivered to its destination, the roof of the box may be adapted to be raised in the manner of a tent. This provides the advantage that it can provide shelter for users of the equipment, especially from rain and/or sun.

The box 1 may be transported by sea, air, road or rail, for example, and internal and external fixings are designed and attached to the box 1 in such a way as to maintain the box 1 weatherproof and so as to minimise breaching the walls of the box. Weatherproofing of the box 1 may be improved by applying a suitable paint, such as a marine paint, which would also reduce corrosion of the box. Internal and/or external components may be coated, for example by powder coating or by hot dip galvanising, to improve appearance and resistance to corrosion. Because portability of the box 1 is important, each box may have associated therewith a unique identification, such as a unique serial number applied to an identification plate, to prove ownership and to facilitate tracing of the box.

Once the box and its contents, forming together the functional training rig kit, arrives at its destination, the box 1 can be unloaded and the functional training rigs can be assembled onto pre-positioned plates provided on the outside of the box. To aid unloading and loading of the box 1, a ramp may be provided in the region of the doors 3. The ramp may hinge back into the box when not required or may be removable so as to be storable within the box. The components 11 are then secured to each other and secured in position on the outside of the box 1, for example by way of threaded or other suitable fasteners. As shown in FIGS. 1 to 8, a functional training rig 13 is secured to and positioned at each side wall of the box 1 and is supported on ground-engaging plates 15. The fasteners may pass through slots formed in at least one of the components 11 and the pre-positioned plates to allow vertical and horizontal adjustment of the or each functional training rig relative to the box prior to final fixing and use of the functional training rigs. Alternatively, a nut may be welded to the outside of the box to receive threaded fasteners from the components 11, or a socket for a pin. If necessary, shims may be provided beneath the ground-engaging plates 15 to ensure the plates are supported. The components 11 may be made of any suitable material, such a square hollow section steel, and may themselves be formed from a number of sub-components which are secured together, for example by welding. Although not shown, a further functional training rig may be secured to and positioned at the rear side wall of the box 1. The plyometric boxes 9 are also removed from the box 1 and the accessories and attachments removed therefrom before the plyometric boxes 9 are positioned around the box 1 for use. That is, the box 1 acts as a support for part of the or each functional training rig and eliminates the needs for some of the support components that would normally be required. If desired, the boxes 9 may be provided with wheels to improve portability thereof.

Figure 9:
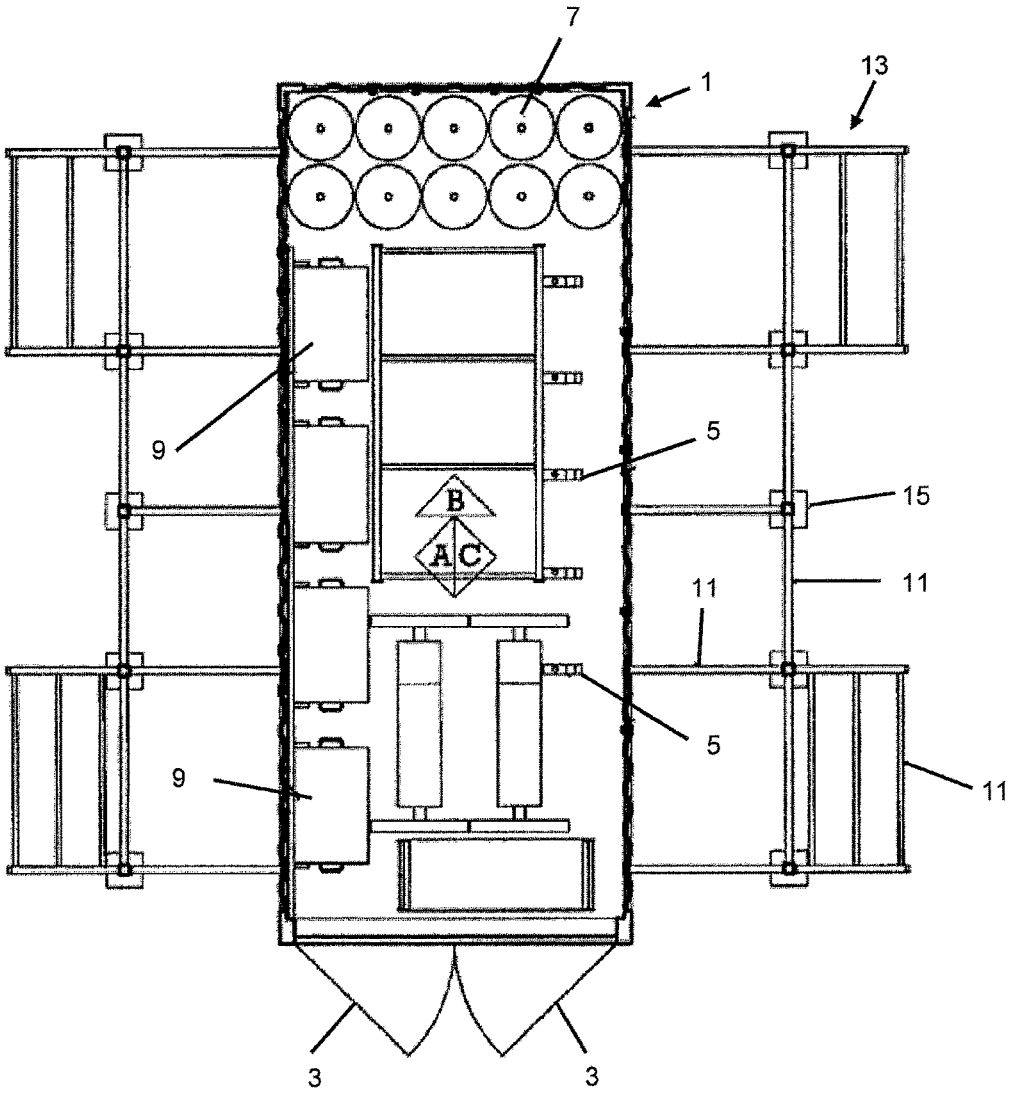
FIG. 9 is a plan view of another embodiment of a functional training rig assembled from a functional training rig kit according to the present invention.
Figure 10:
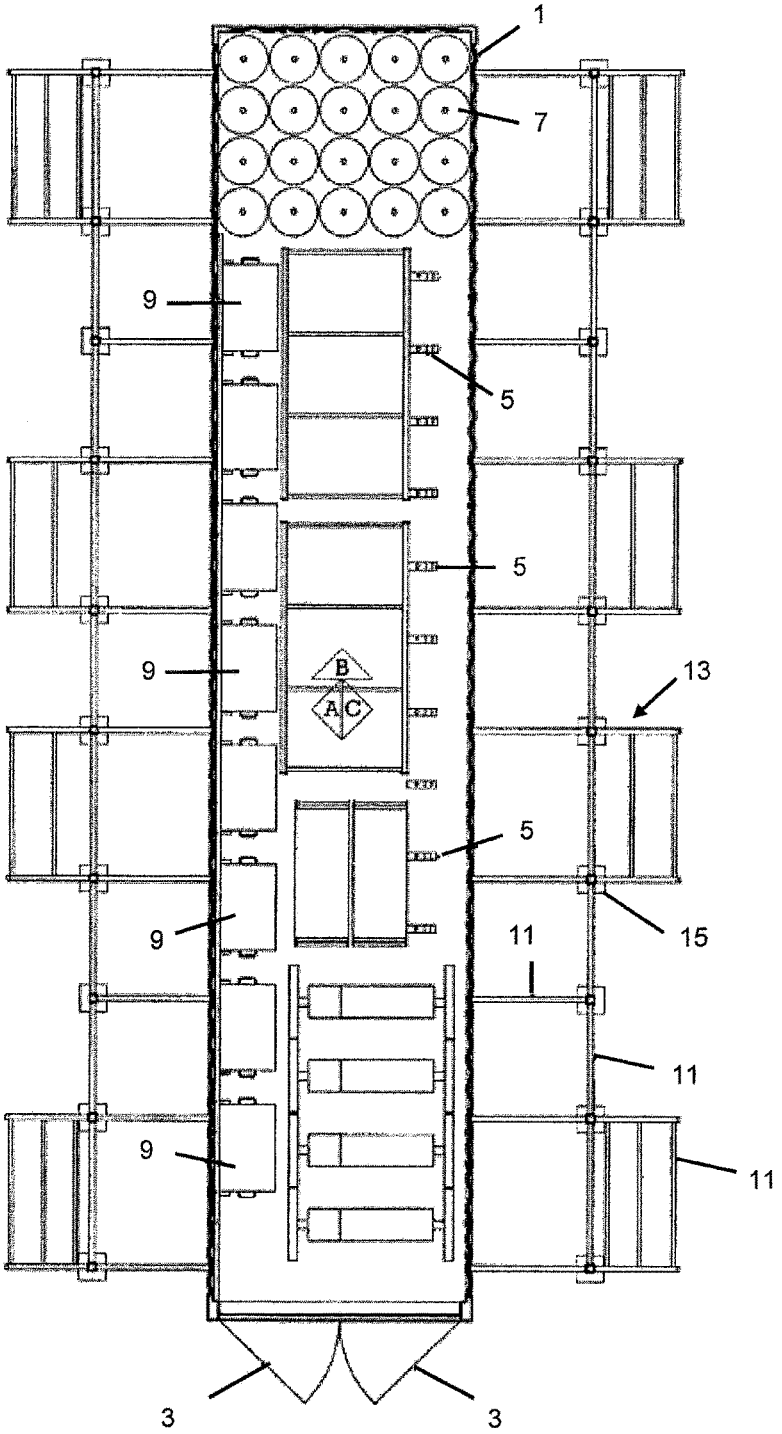
FIG. 10 is a plan view of a further embodiment of a functional training rig assembled from a functional training rig kit according to the present invention.

FIGS. 9 and 10 show arrangements for 6.1 m and 12.2 m ISO shipping containers respectively. There are no differences in principle and the same references are used to denote the same or similar components. In each case, the number of functional training rigs is increased, with four for the 6.1 m container and 8 for the 12.2 m container. Structures for the functional training rigs are shown in FIGS. 9 and 10 together with weightlifting bars 19 and benches 21. The functional training rig(s) allow users to perform a range of functional training exercises, developing body strength using traditional bodyweight exercises. As further gym equipment becomes available, for example targeting different body areas, the traditional bodyweight exercises can be supplemented by the use of such further gym equipment. Such further gym equipment is not always weatherproof and may be of high value, so the box 1 can be used additionally to store this equipment.

Figure 11:
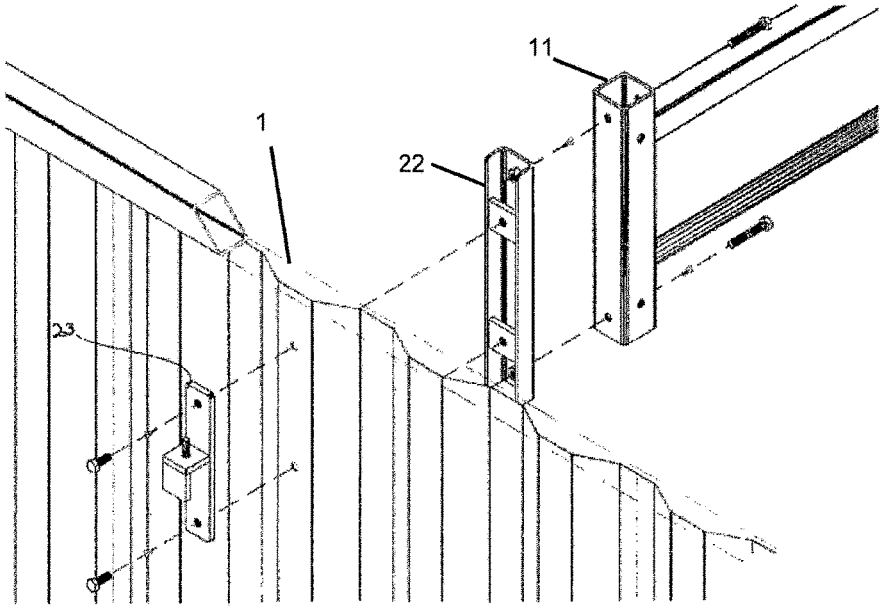
FIG. 11 is a perspective view of a bracket assembly for use in the present invention.

FIG. 11 shows in more detail how the functional training rig 13 can be secured to the box 1. As shown in FIG. 11, a mounting bracket 22 is mounted on a side wall of the box 1 by way of one or more threaded fasteners which pass through an aperture in an attaching bracket 23 and are secured in the mounting bracket 22. More specifically, the mounting bracket 22 is substantially U-shaped in cross-section with the free ends of the U being interconnected by way of transverse ties which are therefore spaced from the base of the U. Transverse ties may be provided in the region of each end of the mounting bracket 22, but alternatively only a single transverse tie may be provided or more than two transverse ties may be provided. The transverse ties are threaded so that the threaded fasteners engage in the transverse ties to secure the mounting bracket 22 at the outside of the box and the attaching bracket 23 at the inside of the box, with the fasteners passing through apertures in the box.

The base of the U of the mounting bracket 22 is formed with an aperture at each end with a captive nut secured to the inside of the base. Alternatively, only a single aperture may be provided along the length of the mounting bracket 22 or more than two such apertures may be provided. Ideally the apertures do not coincide with the transverse ties. A component 11 of the functional training rig 13 is made of substantially square-section material and is formed with apertures corresponding to the apertures in the base of the U of the mounting bracket such that threaded fasteners can pass through the component 11 and engage with the captive nuts to secure the component 11, and therefore the functional training rig 13, to the mounting bracket 22 and in turn to the box 1. The mounting bracket/attaching bracket arrangement eliminates the need to assemble the functional training rig 13 with a person both inside and outside the box 1; the arrangement can also reduce the number of apertures required in the side of the box, which improves weatherproofing of the box; and the arrangement can be a permanent fixture which does not need to be removed from the box (other than for replacement), even when the box is stacked or being transported. Because the mounting bracket/attaching bracket arrangement is not assembled to the wall of the box 1 and disassembled therefrom on a regular basis, the apertures in the wall are not subject to wear and tear which could result in distortion of the apertures and impair assembly of the functional training rig 13 to the box 1. The arrangement may be mounted to the wall of the box 1 at a number of points not essential for mounting the functional training rig, which permits the rig to be mounted at a number of alternative locations relative to the box. The use of threads provided in the arrangement, rather than loose nuts, there is no risk of losing nuts which could compromise mounting of the functional training rig to the box.

Where the wall of the box 1 is corrugated with recessed wall portions and protruding wall portions, the mounting bracket is ideally positioned in a recessed wall portion to reduce the risk of the mounting bracket becoming damaged or interfering with adjoining equipment, such as another shipping container.

As shown in FIG. 11, the attaching bracket 23 may be provided with an auxiliary bracket internally of the box which can be used for supporting gym equipment within the box. The auxiliary bracket can comprise an inverted L-shaped portion with an upstanding peg.

Figure 12:
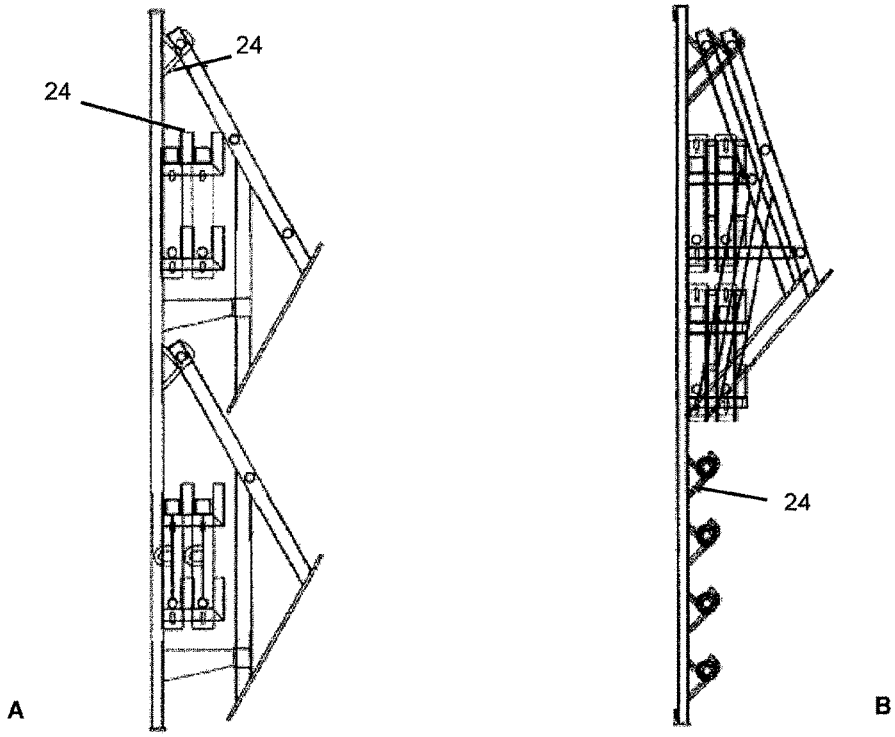
FIG. 12 is a side view of storage racks for use in the present invention.
Figure 13:
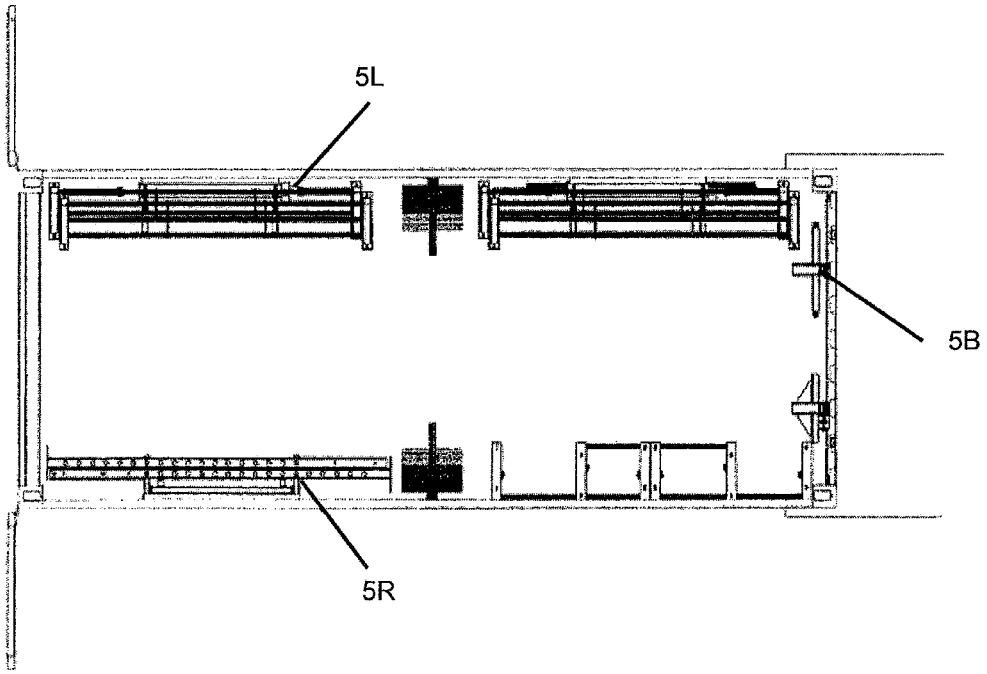
FIG. 13 is a top view of storage racks for use in the present invention.
Figure 14:
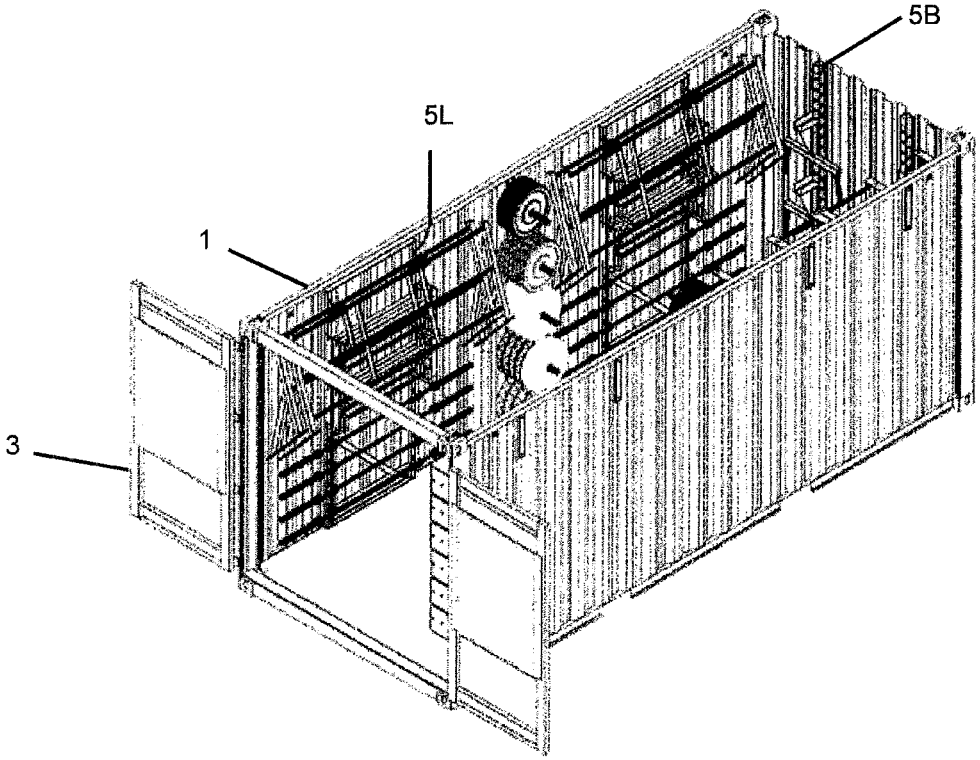
FIG. 14 is a first perspective view corresponding to FIG. 13.
Figure 15:
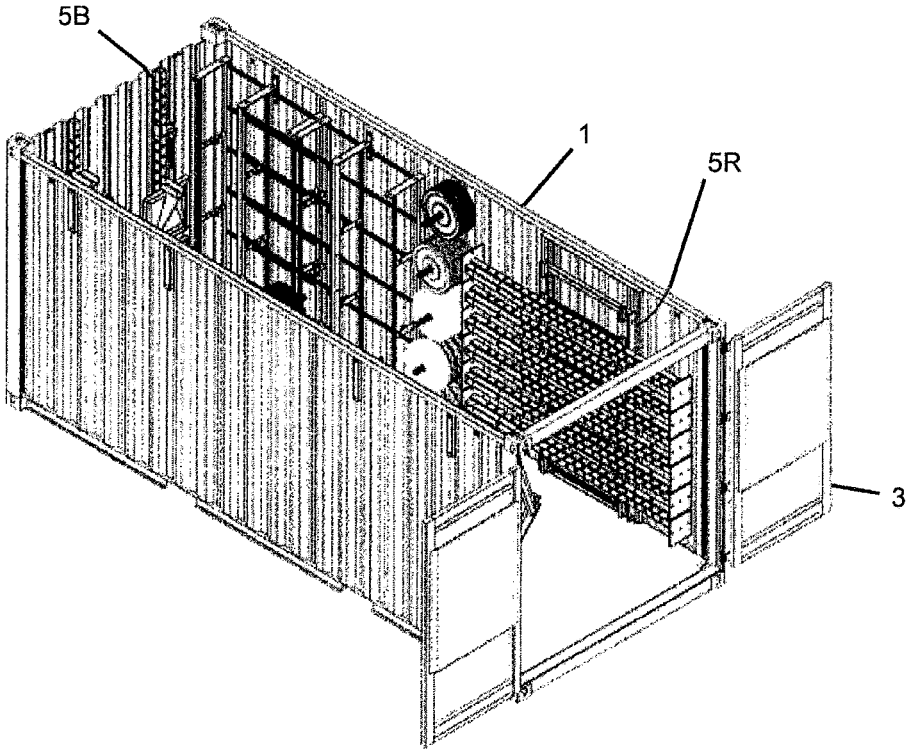
FIG. 15 is a second perspective view corresponding to FIG. 13.

FIGS. 12 (A and B) shows two alternative internal racks for the box 1, with support brackets 24 mounted on the internal wall of the box 1 to keep the floor space within the box 1 as clear as possible and to improve safety for users when packing or unpacking the box. FIG. 13 illustrates three different types of storage racks, 5B, 5R and 5L for different types of equipment. FIG. 14 is a perspective view from one direction corresponding to FIG. 13 showing storage racks 5B and 5L, while FIG. 15 is a perspective view from another direction showing racks 5B and 5R. It will be noted the top of the box 1 has been omitted in FIGS. 14 and 15 for clarity.

Figure 16:
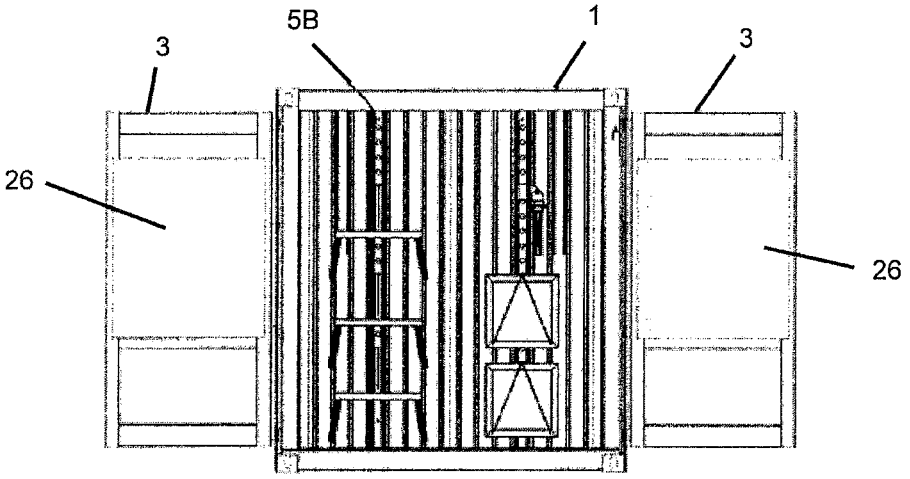
FIG. 16 is an end view corresponding to FIG. 13.

FIG. 16 shows the storage rack 5B in more detail together with a writing surface 26, such as a white board, on the inside of each door 3. The writing surface may be used for a number of purposes, such as keeping records of exercises carried out by users and/or for recording a list of the contents of the box 1. Markers may also be provided for use with the writing surfaces. Alternatively, a document holder may be provided on the inside of the doors to keep appropriate documents.

Figure 17:
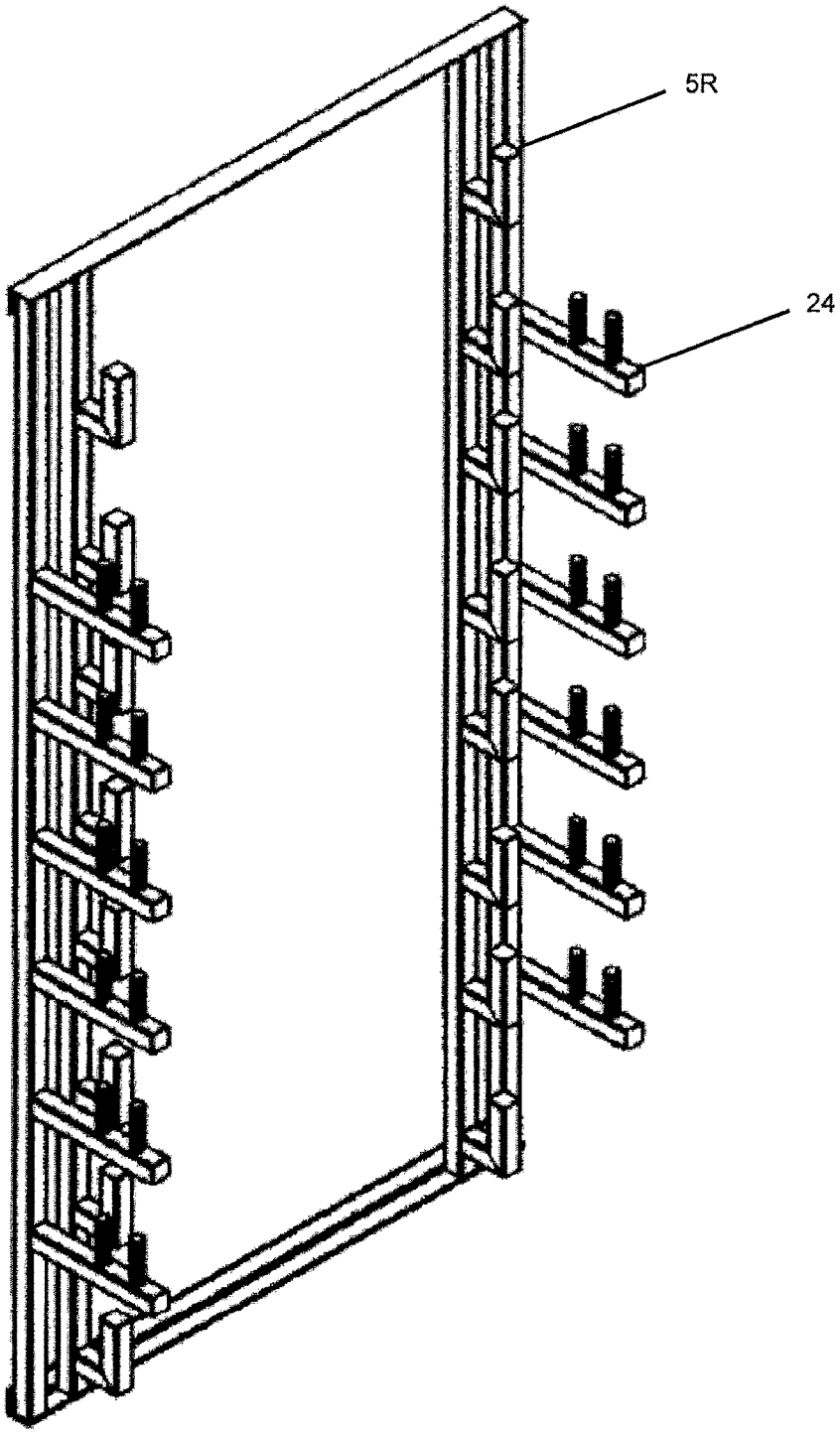
FIG. 17 is a perspective view of one embodiment of a storage rack for use in the present invention.
Figure 18:
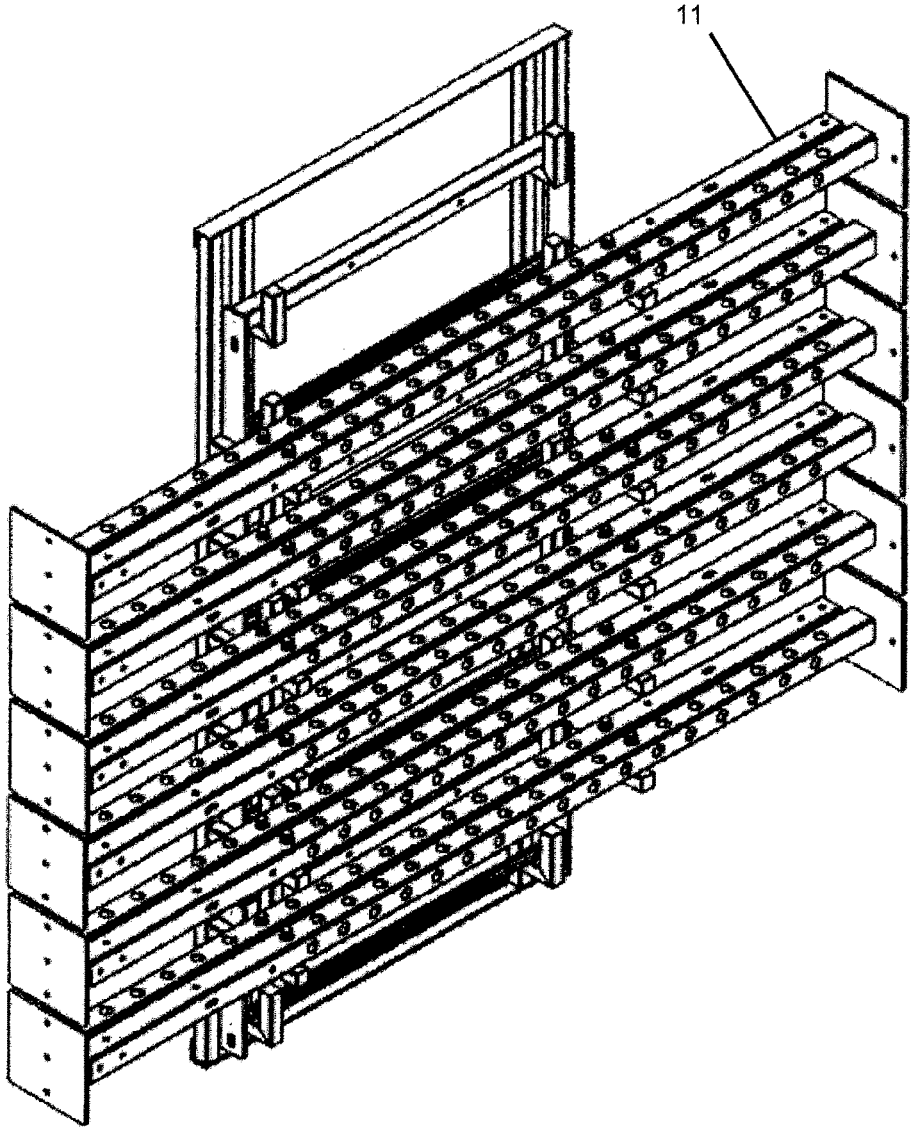
FIG. 18 is a perspective view of another embodiment of a storage rack for use in the present invention.

FIGS. 17 and 18 show the storage rack 5R in more detail, including support brackets 24. FIG. 18 shows a number of components 11 of the functional training rig 13 supported on the support brackets 24 of storage rack 5R.

Figure 19:
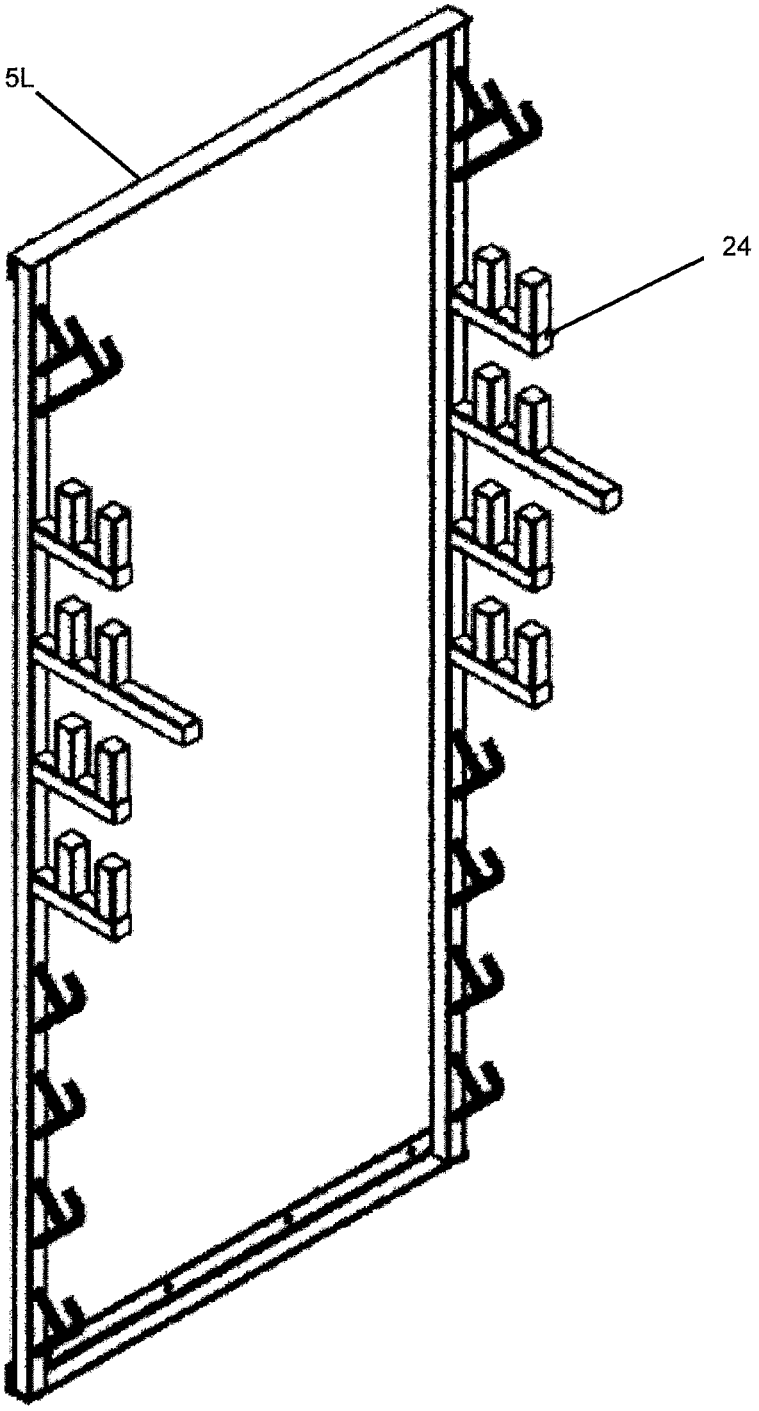
FIG. 19 is a perspective view of a further embodiment of a storage rack for use in the present invention.
Figure 20:
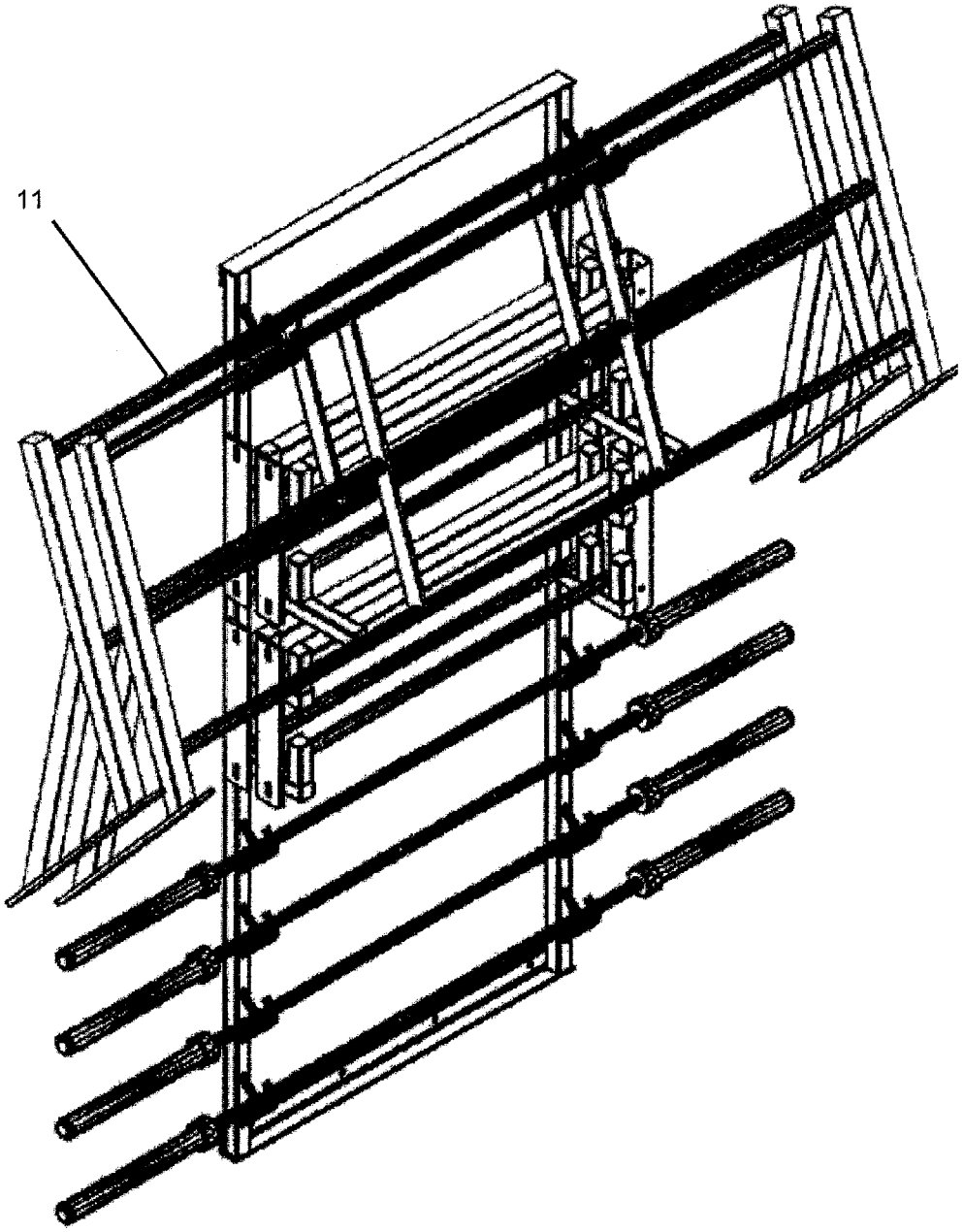
FIG. 20 corresponds to FIG. 19 but with components of a functional training rig supported on the storage rack.

FIGS. 19 and 20 show the storage rack 5L in more detail, including support brackets 24. FIG. 20 shows a number of components 11 of the functional training rig 13 supported on the brackets 24 of storage rack 5R. A positive restraining device may be provided or included in the storage racks 5B, 5R and 5L to secure the components 11 during transportation of the box 1. The position of the racks and the type of components 11 they are adapted to support may be determined with a number of considerations in mind, such as removing the components 11 from the box 1 in a preferred sequence for construction of the functional training rig 13 (and vice versa) and for ensuring there is a substantially even distribution of weight throughout the box in order to facilitate lifting and moving the box with, for example, a fork-lift truck.

Figure 21:
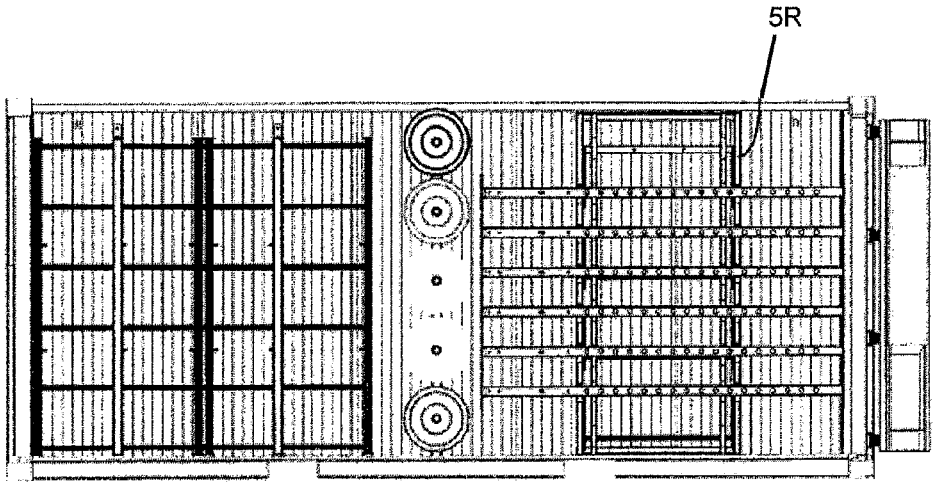
FIG. 21 is a side view corresponding to FIG. 15.
Figure 22:
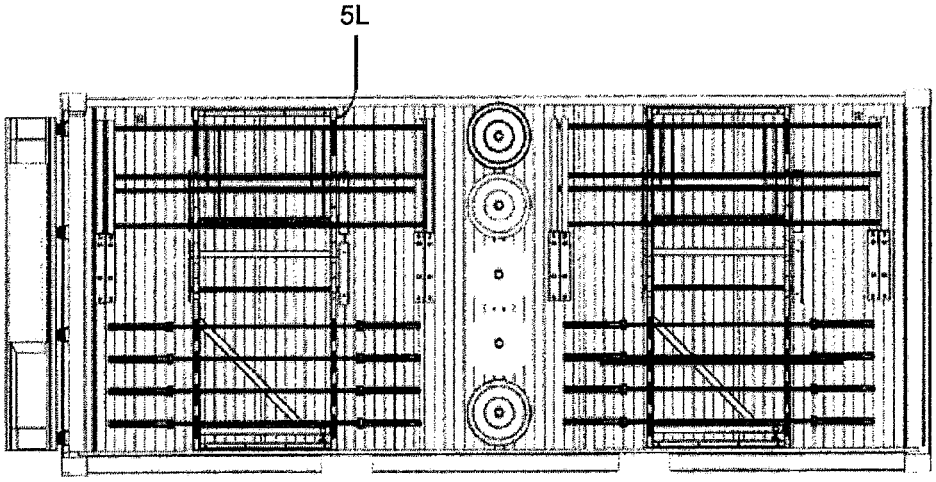
FIG. 22 is a side view corresponding to FIG. 14.

FIG. 21 is a side view corresponding to FIG. 15 showing storage rack 5R, While FIG. 22 is a side view corresponding to FIG. 14 showing storage rack 5L.

Figure 23:
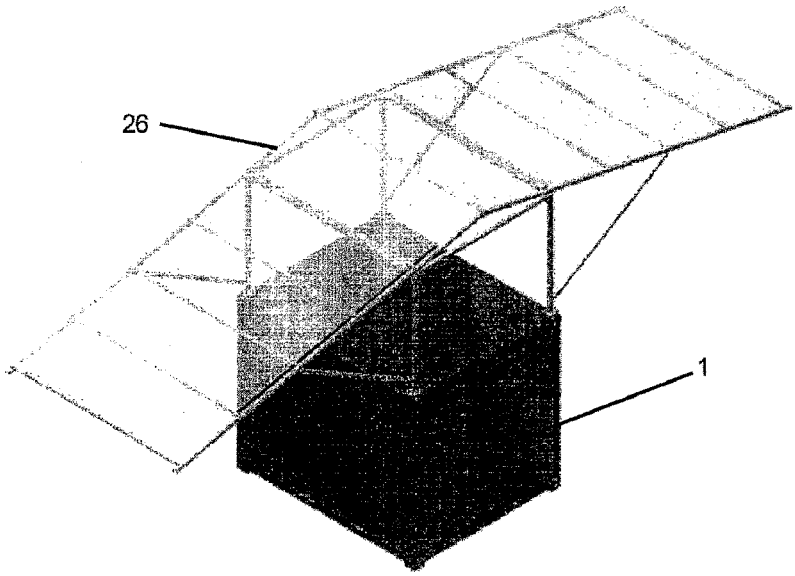
FIGS. 23 and 24 show a canopy for use in the present invention.
Figure 24:
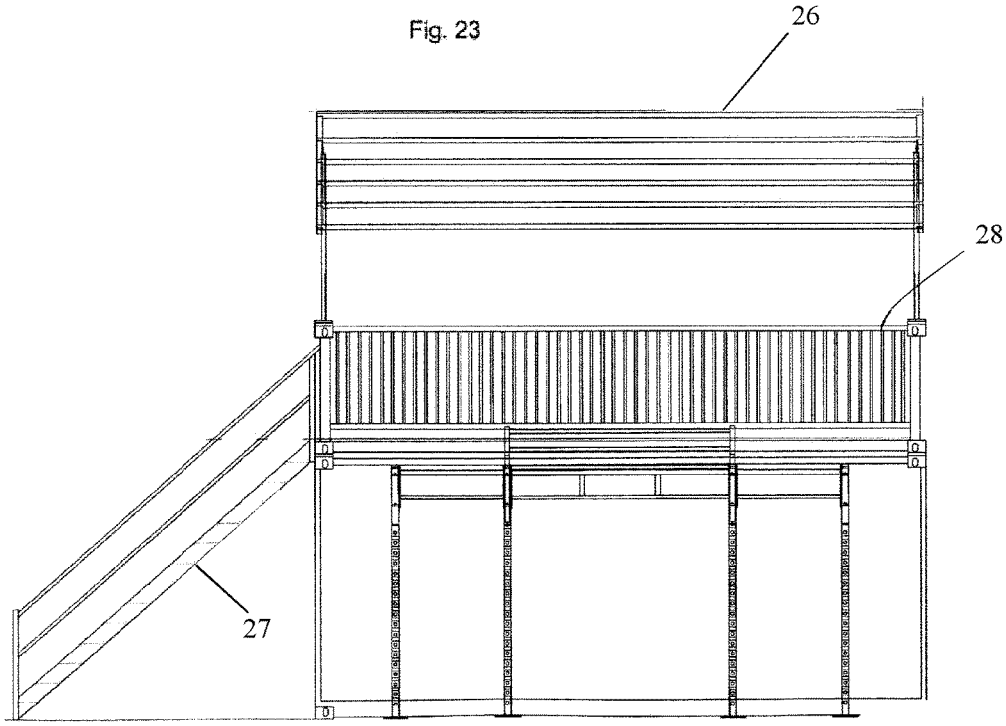

FIGS. 23 and 24 show that a canopy 26 can be provided over the box 1 for use with the functional training rig to provide shelter against inclement weather or the sun. As illustrated, the canopy 26 extends over and beyond the box 1, but it is not essential that the canopy extends over the box. However, as shown in FIG. 24, where the canopy 26 does extend across the box 1, stairs 27 may be provided to access the top of the box and a handrail 28 may be provided around the edges of the top of the box for safety purposes.

Figure 25:
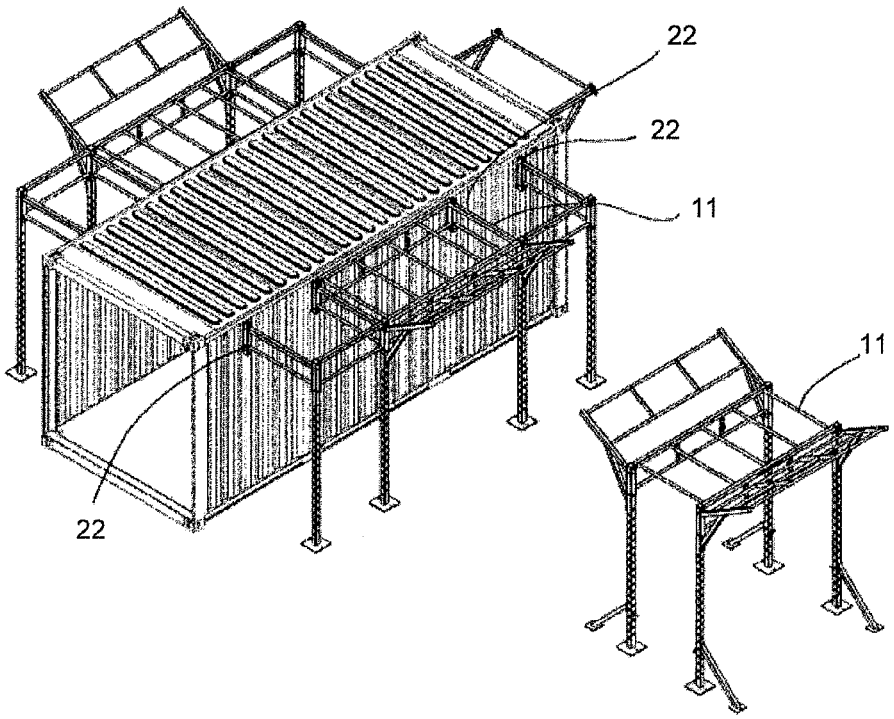
FIGS. 25 to 30 illustrate the modular nature of functional training rigs according to the present invention.
Figure 26:
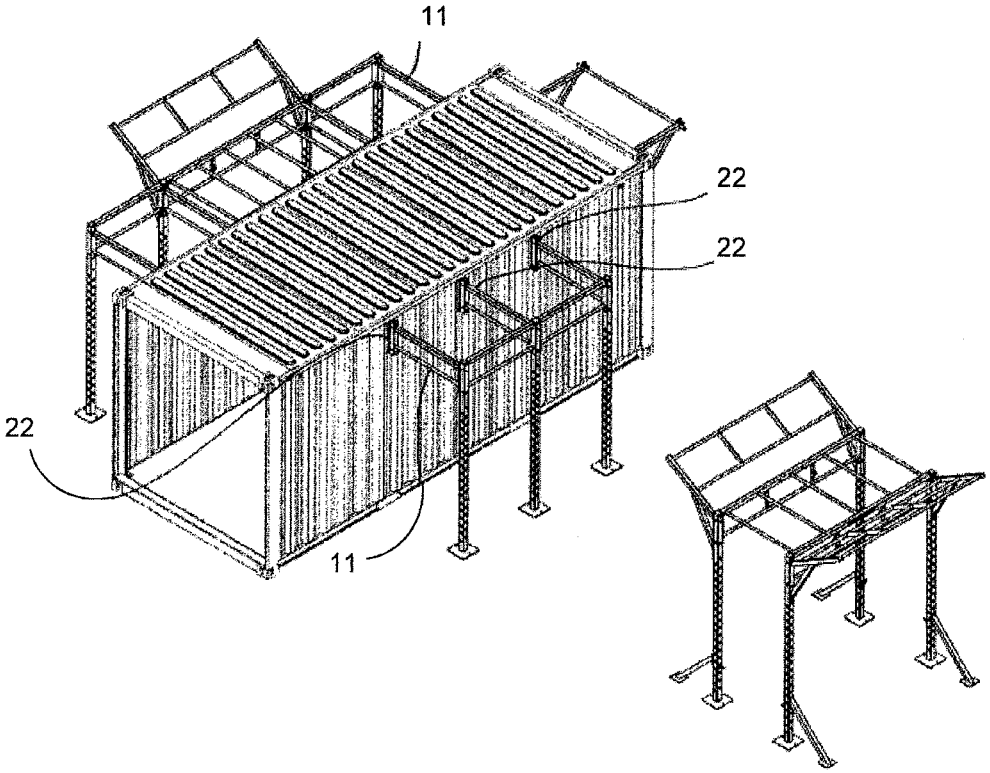
Figure 27:
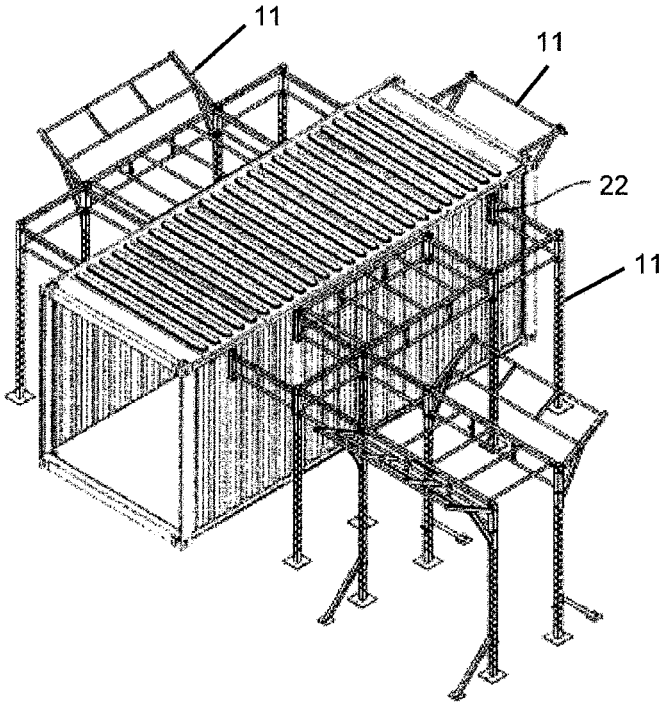
Figure 28:
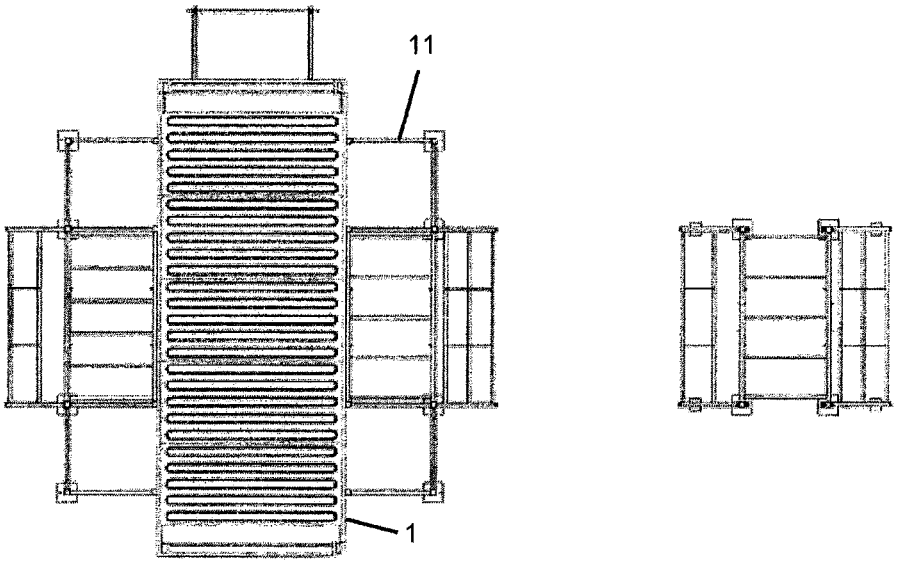

FIGS. 25 to 28 illustrate the modular nature of the functional training rigs 13, using components 11 mounted to the side of the box 1 by way of mounting brackets 22, with FIGS. 25, 26 and 27 showing how the nature of the functional training rig can be modified. FIG. 28 is a plan view corresponding to the perspective view of FIG. 25.

Figure 29:
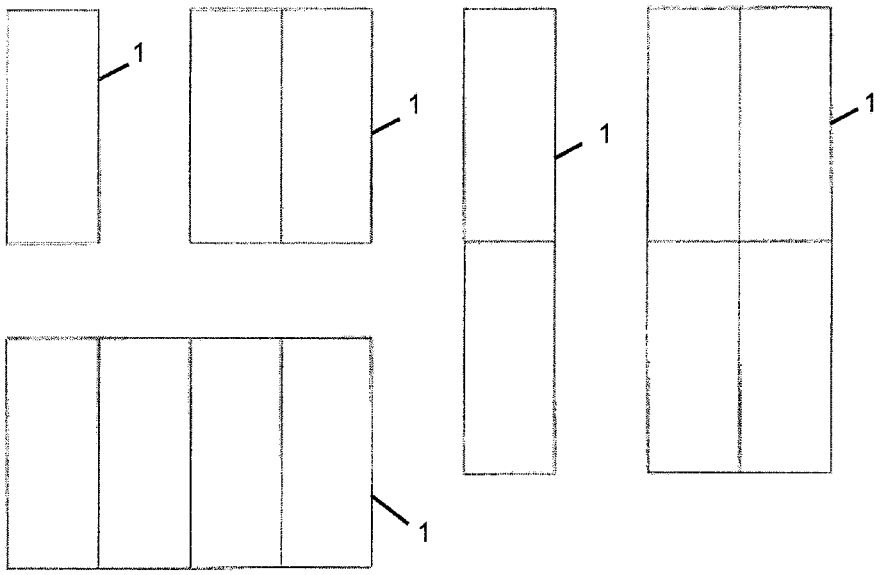
Figure 30:
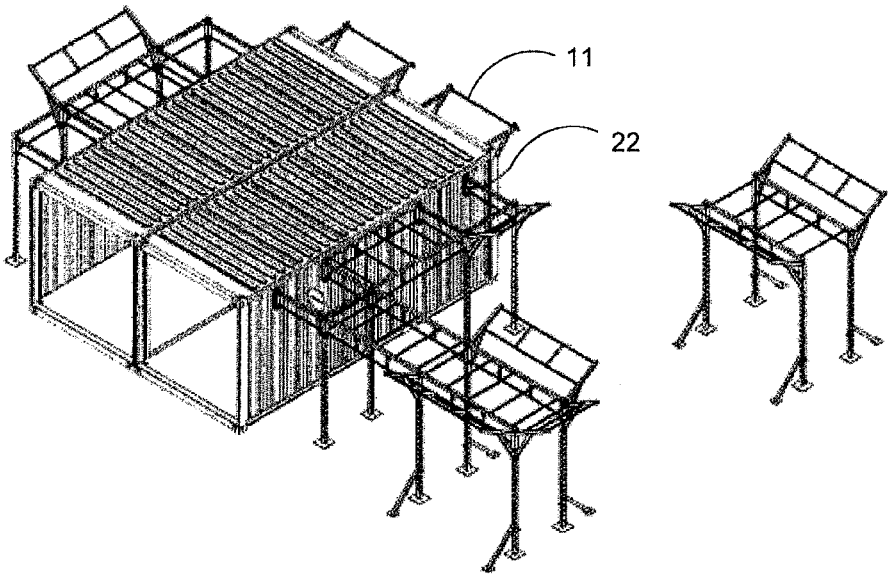

FIG. 29 illustrates how one or more boxes 1 can be employed, showing in particular, in addition to a single box, how boxes can be used in pairs or in groups of four. Where boxes are arranged side-by-side or end-to-end, the respective sides or ends of the boxes may be arranged to fold away to create a larger single internal area, which could be used for training purposes. FIG. 30 shows such an arrangement together with the components 11 of a functional training rig mounted to the outside of the box 1 by way of mounting brackets 22.

The invention claimed is:

1. A functional training rig kit comprising a box and a plurality of components adapted to fit within the box, at least one of the plurality of components is attachable to an outside of the box to provide at least one functional training rig attached to the outside of the box when the box is positioned on a ground surface, wherein the box comprises an ISO shipping container, wherein the functional training rig is adapted to be supported both by the outside of the box and by the ground surface, wherein the functional training rig comprises a plurality of horizontal components of said plurality of components, wherein the plurality of horizontal components each comprise an end, wherein said ends of said plurality of horizontal components are securable to a vertical outside wall of the box such that said plurality of horizontal components project horizontally from and normal to said vertical outside wall of the box, wherein each of the horizontal components is connectable with one of a plurality of respective vertical components of said plurality of components engageable with the ground surface, and wherein the vertical outside wall of the box is a vertical outside wall of the box when the functional training rig is deployed.

2. The functional training rig as claimed in claim 1, wherein the functional training rig comprises a bar extending parallel to the outside wall of the box and is adapted to horizontally interconnect at least one of a first one of said horizontal components projecting horizontally from the vertical outside wall of the box and a respective first one of said vertical components with at least one of a second one of said horizontal components projecting horizontally from the vertical outside wall of the box and a second respective one of said vertical components.

3. The functional training rig kit as claimed in claim 1, wherein the functional training rig comprises a plurality of cantilever components, a first one of the cantilever components being supportable by at least one of a first one of said horizontal components projecting horizontally from the outside wall of the box and a first respective one of said vertical components, and a second of the plurality of cantilever components being supportable by at least one of a second one of said horizontal components projecting horizontally from the outside wall of the box and a second respective one of said vertical components, and at least one horizontal bar adapted to be interconnectable between the first and second cantilever components.

4. The functional training rig kit as claimed in claim 1, wherein the at least some of the components of the at least one functional training rig are assemblable onto pre-positioned plates provided on the outside of the box.

5. The functional training rig kit as claimed in claim 1, wherein the at least one functional training rig is attachable to the outside of the box in such a way that vertical and/or horizontal movement between the functional training rig and the box is permitted.

6. The functional training rig kit as claimed in claim 1, wherein the at least one functional training rig is secured to the box by way of threaded or other suitable fasteners.

7. The functional training rig kit as claimed in claim 1, wherein the box is provided with hinged upright doors.

8. The functional training rig kit as claimed in claim 1, wherein the ISO shipping container has a length of 3 meters, 6.1 meters or 12.2 meters.

9. The functional training rig kit as claimed in claim 1, wherein components of the at least one functional training rig are stored on storage racks within the box for transportation.

10. The functional training rig kit as claimed in claim 1, wherein accessories and attachments for the at least one functional training rig are stored within the box.

11. The functional training rig kit as claimed in claim 1, wherein, in use, the at least one functional training rig is supported on at least one ground-engaging plate.

12. The functional training rig kit as claimed in claim 1, wherein the ISO shipping container comprises walls which are corrugated.

13. A functional training rig secured to a box, the box positioned on a ground surface, the functional training rig comprising a plurality of components adapted to fit within the box, at least one of the plurality of components attached to the outside of the box such that a portion of the functional training rig is attached to an outside of the box positioned on the ground surface, wherein the box comprises an ISO shipping container, wherein the functional training rig is supported both by the outside of the box and by the ground surface, wherein the functional training rig comprises a plurality of horizontal components of said plurality of components, wherein the plurality of horizontal components each comprise an end, wherein said ends of said plurality of horizontal components are secured to a vertical outside wall of the box, wherein each of the horizontal components projects horizontally from and normal to the vertical outside wall of the box and connects to one of a plurality of respective vertical components of said plurality of components which engage the ground surface, and wherein the vertical outside wall of the box is a vertical outside wall of the box when the functional training rig is deployed.

14. The functional training rig secured to the box as claimed in claim 13, wherein the functional training rig comprises a bar extending parallel to the outside wall of the box and horizontally interconnecting at least one of a first one of said horizontal components projecting horizontally from the outside wall of the box and a first respective one of said vertical components with at least one of a second one of said horizontal components projecting horizontally from the outside wall of the box and a second respective one of said vertical components.

15. The functional training rig secured to the box as claimed in claim 13, wherein the functional training rig comprises a plurality of cantilever components, a first of the cantilever components being supported by at least one of a first one of said horizontal components projecting horizontally from the outside wall of the box and a first respective one of said vertical components, and a second of the plurality of cantilever components being supported by at least one of a second one of said horizontal components projecting horizontally from the outside wall of the box and a second respective one of said vertical components, and at least one horizontal bar interconnecting the first and second cantilever components.

16. The functional training rig secured to the box as claimed in claim 13, wherein the ISO shipping container comprises walls which are corrugated.

17. The functional training rig secured to the box as claimed in claim 13, wherein the functional training rig is supported on at least one ground-engaging plate.

18. A functional training rig kit comprising a box and a plurality of components adapted to fit within the box, at least one of the plurality of components is attachable to an outside of the box to provide at least one functional training rig attached to the outside of the box when the box is positioned on a ground surface, wherein the box comprises an ISO shipping container, wherein the functional training rig is adapted to be supported both by the outside of the box and by the ground surface, wherein the functional training rig comprises a plurality of horizontal components of said plurality of components, wherein the plurality of horizontal components each comprise an end, wherein said ends of said plurality of horizontal components are securable to a vertical outside wall of the box to such that said plurality of horizontal components project horizontally from and normal to said vertical outside wall of the box, wherein each of the horizontal components connectable with one of a plurality of respective vertical components of said plurality of components engageable with the ground surface, wherein the vertical outside wall of the box is a vertical outside wall of the box when the functional training rig is deployed, wherein the functional training rig comprises a plurality of cantilever components, a first of the cantilever components being supportable by at least one of a first one of said horizontal components projecting horizontally from the outside wall of the box and a first respective one of said vertical components, and a second of the plurality of cantilever components being supported by at least one of a second one of said horizontal components projecting horizontally from the outside wall of the box and a second respective one of said vertical components, and at least one horizontal bar interconnecting the first and second cantilever components.

19. The functional training rig kit as claimed in claim 18, wherein the functional training rig comprises a bar extending parallel to the outside wall of the box and is adapted to horizontally interconnect at least one of the first one of said horizontal components projecting horizontally from the vertical outside wall of the box and the respective first one of said vertical components with at least one of the second one of said horizontal components projecting horizontally from the vertical outside wall of the box and the second respective one of said vertical components.

* * * * *